US009109335B1

(12) United States Patent
Groves

(10) Patent No.: US 9,109,335 B1
(45) Date of Patent: Aug. 18, 2015

(54) RETRACTABLE DOCK

(71) Applicant: Oliver Groves, Freeland, WA (US)

(72) Inventor: Oliver Groves, Freeland, WA (US)

( * ) Notice: Subject to any disclaimer, the term of this patent is extended or adjusted under 35 U.S.C. 154(b) by 0 days.

(21) Appl. No.: 14/525,083

(22) Filed: Oct. 27, 2014

(51) Int. Cl.
*E01D 15/20* (2006.01)
*E01D 15/24* (2006.01)

(52) U.S. Cl.
CPC ..... *E01D 15/20* (2013.01)

(58) Field of Classification Search
USPC ..... 14/2.6, 27, 28, 29, 30, 71.1, 71.5
IPC ..... E01D 15/10,15/12, 15/145, 15/20, E01D 15/24
See application file for complete search history.

(56) References Cited

U.S. PATENT DOCUMENTS 3,004,391 A * 10/1961 Miller ..... 405/219
4,297,759 A * 11/1981 Soffge et al. ..... 14/2.6
4,441,449 A * 4/1984 Biaggi ..... 114/263
4,602,697 A * 7/1986 Aanensen ..... 182/48
4,675,931 A * 6/1987 Quint ..... 14/71.1
5,216,773 A * 6/1993 Haakonsen ..... 14/2.6
5,374,154 A * 12/1994 Alten ..... 414/537
6,739,279 B2 * 5/2004 Funk ..... 114/362
2003/0074749 A1 * 4/2003 Smith ..... 14/2.6
2009/0038088 A1 * 2/2009 Adler et al. ..... 14/2.6
2012/0204361 A1 * 8/2012 Anderberg ..... 14/71.1

* cited by examiner

*Primary Examiner* — Gary Hartmann
(74) *Attorney, Agent, or Firm* — Michael D. Eisenberg

(57) ABSTRACT

A retractable dock having a ramp, with first forward and aft sides, extending from a bulkhead toward water. The first aft side joins the bulkhead via a locking mechanism. All locking mechanisms allow rotation. The dock has an aft floating assembly with an aft bridge and second aft and forward sides. The second aft side joins the first forward side of the ramp via a second locking mechanism. The aft float assembly has an aft floating unit floating on water supporting the aft bridge. The aft floating unit joins the aft bridge by another locking mechanism. The second locking mechanism joins to the ramp and either the second aft side or aft floating unit. The dock has a forward floating assembly with a forward bridge joined to the aft bridge configured for extension and retraction. The forward floating assembly has a forward floating unit floating under the forward bridge supporting it.

19 Claims, 13 Drawing Sheets

RETRACTABLE DOCK

TECHNICAL FIELD

The present invention, in some embodiments thereof, relates to docks for enabling passage between a naval vessel located on a body of water and a coast or bank or edge of the same body of water.

BACKGROUND OF THE INVENTION

Some naval vessels are too large to approach an edge of a body of water in order to enable passengers or crew to board the vessel. Docks extend from the edge of the body of water to the vessel, to allow access to the vessel.

Docks commonly used today consist of boards or blocks that are supported by pilings that are fixed to the bottom of the body of water. Thus, current docks may block sunlight to some sections of the body of water, both during low and high tide. This may prevent the growth of marine life.

The pilings driven into the ground and in constant contact with water. The contact between the water and the pilings may cause the pilings to deteriorate over time. Thus the pilings require treatment against deterioration. If pilings deteriorate, they need to be replaced. Adverse weather conditions may also cause damage to the pilings and/or to the other sections of the docks.

Current docks used in salt water have creosote pilings. If left untreated, creosote pilings deteriorate over time, releasing creosote particles in the water. Creosote is known to be toxic to humans. In fact, according to the Agency for Toxic Substances and Disease Registry (ATSDR), eating food or drinking water contaminated with high levels of coal tar creosote may cause a burning in the mouth and throat, and stomach pains. ATSDR also states that brief direct contact with large amounts of coal tar creosote may result in a rash or severe irritation of the skin, chemical burns of the surfaces of the eyes, convulsions and mental confusion, kidney or liver problems, unconsciousness, and even death. Longer direct skin contact with low levels of creosote mixtures or their vapors can result in increased light sensitivity, damage to the cornea, and skin damage. Longer exposure to creosote vapors can cause irritation of the respiratory tract. The International Agency for Research on Cancer (IARC) has determined that coal tar creosote is probably carcinogenic to humans, based on adequate animal evidence and limited human evidence. The United States Environmental Protection Agency has stated that coal tar creosote is a probable human carcinogen based on both human and animal studies.

BRIEF SUMMARY OF EMBODIMENTS OF THE INVENTION

There is therefore a need for a dock that does not need constant treatment against deterioration and with decreased adverse effects to the environment.

The present invention relates to a retractable floating dock, which can be extended to reach a vessel and allow access thereto, and retracted when not in use. The dock of the present invention includes an aft float unit and a forward float unit connected by telescopically retractable bridge comprised of a forward bridge and an aft bridge. The aft float assembly (comprised of the aft float unit and the aft bridge) is a floating assembly that is proximal to the beach and is joined to a ramp that is joined to a bulkhead. The forward float assembly (comprised of the forward float unit and the forward bridge) is a floating assembly which is located distally from the beach and is configured for being proximal to a vessel, to enable access to the vessel. The retractable bridge assembly includes at least one bridge that can be retracted into the aft float assembly and/or into the for forward float assembly. When the bridge assembly is retracted, the platform dock assembly is brought to the proximity of the main float assembly, thus decreasing the length of the dock.

Thus, the retractable dock of the present invention can be retracted during storms or in bad weather conditions, in order to decrease the risk of damage to the dock. Also, in its retracted configuration, the dock's surface is decreased, enabling more sunlight to reach some sections of the body of water. In this manner, damage to marine life due to the absence of sunlight is reduced.

Moreover, the dock is not supported by elements that are fixed to the bottom of the body of water. Instead, the dock includes floating elements that keep the dock above water. Thus, the risk of collapse of the dock due to failure of these support elements is null.

The present invention relates to a retractable dock having a ramp that extends from a bulkhead on dry land toward a body of water. The ramp has both a first forward side and a first aft side, and the first aft side is joined to the bulkhead via a first locking mechanism. The first locking mechanism enables rotation of the ramp with respect to the bulkhead around a first substantially horizontal axis. The retractable dock has an aft floating assembly. The aft float assembly has an aft bridge with a second aft side and a second forward side. The second aft side is joined to the first forward side of the ramp via a second locking mechanism which enables rotation of the aft bridge with respect to the ramp around a second substantially horizontal axis. The aft float assembly has an aft floating unit that is configured to float on the body of water and support the aft bridge. The aft floating unit is joined to the aft bridge by a third locking mechanism, which enables rotation of the bridge with respect to the aft floating unit around a third substantially horizontal axis. The second locking mechanism is joined to the ramp and to either the second aft side or to the aft floating unit, and the second locking mechanism is configured to enable rotation of the aft floating assembly with respect to the ramp around a second substantially horizontal axis. The retractable dock has a forward floating assembly. The forward floating assembly has a forward bridge joined to the aft bridge, it is configured for telescopically extending from and retracting to the aft bridge. The forward floating assembly additionally has a forward floating unit for floating on the body of water under the forward bridge, and is configured for supporting at least part of a weight of the forward bridge. The forward floating unit and the aft floating unit are configured to together support the forward bridge and aft bridge.

In a variant at least one bridge unit is joined to the aft bridge and to the forward bridge such that the at least one bridge unit is configured for telescopically extending from and retracting to the aft bridge, while the forward bridge is configured to telescopically extend from and retract to the at least one bridge unit. In a further variation the "at least one" bridge unit comprises a set of bridges arranged in series with the set being telescopically extendible from and retractable. The first bridge of the set is joined to the aft bridge and is configured for telescopically extending from and retracting to the aft bridge, while the last bridge of the set is joined to the forward bridge such that the forward bridge is configured for telescopically extending from and retracting to the aft bridge.

In another variant of the retractable bridge an electric motor and pulley system may operate the telescopic retraction and extension. The electric motor and pulley system has a first pulley and a second pulley. The first pulley is located at a more forward location along the forward bridge than the second pulley. A is belt stretched between the first and second pulleys such that the belt rotates about the first and second pulleys when a least one of the first and second pulleys rotates. A motor is connected to the first pulley and configured for causing the first pulley to rotate about the first pulley's center, such that the belt is in contact with the aft bridge and the a motion of the belt causes the forward bridge to translate along to the aft bridge.

In a further variant of the electric motor and pulley system a track extends on the side of the aft bridge along at least part of the aft bridge's length. Joined to the forward bridge and configured for engaging the track is at least one lock glider, so as to restrict a motion of the forward bridge along the aft bridge to translation.

In a further variant of the electric motor and pulley system, a clamp attachment is joined to a top surface of the aft bridge and configured for pushing the belt of the forward bridge against the top surface of the aft bridge, thus maintaining the contact between the forward bridge's belt and the aft bridge's top surface.

In a variant of the retractable dock with a series of bridges the motion of at least one bridge with respect to a second bridge adjacent to the at least one bridge located at a more forward location of than the at least one bridge is caused by an electric motor and pulley system. The electric motor and pulley system has a first pulley and a second pulley with the first pulley being located at a more forward location along the adjacent bridge than the second pulley. A belt stretches between the first and second pulleys such that the belt rotates about the first and second pulleys when a least one of the first and second pulleys rotates. A motor connected to the first pulley and configured for causing the first pulley to rotate about the first pulley's center, such that the belt is in contact with the at least one bridge and the motion of the belt causes the adjacent bridge to translate along to the at least one bridge.

The variation of the retractable bridge with a series of bridges and an electric motor and pulley system further having a track extending on the side of the aft bridge along at least part of a length of the at least one bridge and at least one lock glider. The lock glider is joined to adjacent bridge and configured for engaging the track, so as to restrict a motion of the adjacent bridge along the at least one bridge to translation.

A further variation having a clamp attachment joined to a top surface of the at least one bridge configured for pushing the belt of the adjacent bridge against the top surface of the at least one bridge, thus maintaining the contact between the adjacent bridge's belt and the top surface of the at least one bridge.

A further variation of the retractable dock having an electric motor and pulley system for operating the telescopic retraction and extension. The electric motor and pulley system having a first pulley and a second pulley and the first pulley is located at a more aft location along the aft bridge than the second pulley. A belt stretches between the first and second pulleys such that the belt rotates about the first and second pulleys when a least one of the first and second pulleys rotates. A motor is connected to the first pulley and configured for causing the first pulley to rotate about the first pulley's center such that the belt is in contact with the forward bridge and the motion of the belt causes the aft bridge to translate along to the forward bridge.

A further variation having a track extend on the side of the forward bridge along at least part of the forward bridge's length and a lock glider. The lock glider is joined to the aft bridge and configured for engaging the track, so as to restrict a motion of the aft bridge along the forward bridge to translation.

A variation of the retractable bridge having at least one removable and/or permanent floor plate on at least one of the aft bridge and forward bridge such that a walkable surface is provided.

A variation of the retractable bridge having an aft anchor lock joined to the aft floating unit configured for detachably engaging an end of an anchor line extending from an anchor affixed to dry land and/or to a bed of the body of water.

A variation of the retractable bridge having a forward anchor lock joined to the aft floating unit configured for detachably engaging an end of an anchor line extending from an anchor affixed to a bed of the body of water.

A variation of the retractable bridge having floatation devices joined to the aft and forward floatation units. A further variation wherein the floatation devices are joined to the lateral edges of the aft and/or forward floatation units. An alternate variation wherein the floatation devices are uniformly distributed throughout bottom surfaces of the aft and/or forward floatation units.

A variation of the retractable bridge having one or more counterweights on the aft floating unit and/or forward floating unit for balance during extension.

A variation of the retractable bridge having at least one floor lock. The floor lock is joined to the forward bridge, and is configured for being inserted into an opening on a forward end of a floor of the aft bridge, to lock the forward bridge and aft bridge when the forward bridge is extended from the aft bridge, and for being retracted from the opening to enable motion of the forward bridge with respect to the aft bridge. An alternate variation wherein the floor lock is joined to the aft bridge, and is configured for being inserted into an opening on a aft end of a floor of the forward bridge, to lock the aft bridge and aft bridge when the aft bridge is extended from the forward bridge, and for being retracted from the opening to enable motion of the aft bridge with respect to the forward bridge.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
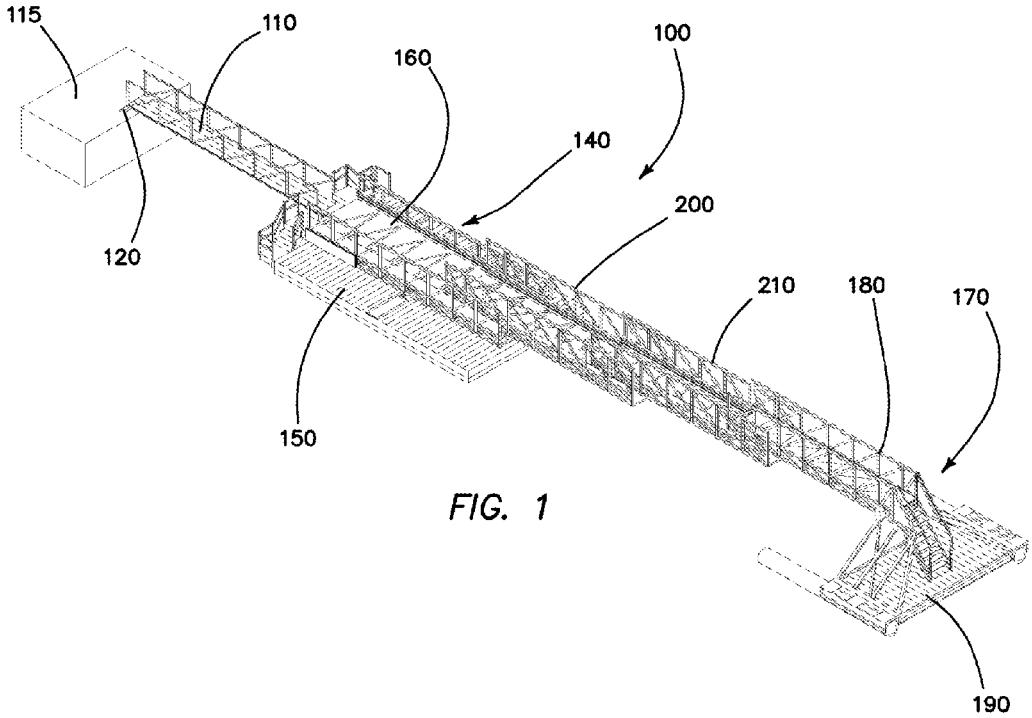
FIGS. 1 and 2 are drawings illustrating a perspective view and a side view, respectively, of a dock of the present invention in an extended configuration thereof.
Figure 2:
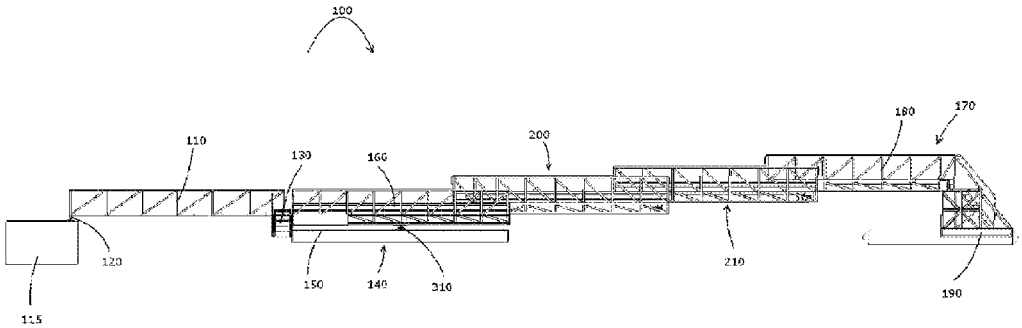

FIGS. 1 and 2 are drawings illustrating a perspective view and a side view, respectively, of a dock 100 of the present invention in an extended configuration thereof. The dock 100 includes a ramp 110 extending forward from a bulkhead 115, an aft float 140 assembly joined to the ramp, and a forward float assembly 170 joined to the aft floating assembly. The aft float assembly 140 includes an aft float unit 150 and an aft bridge 160. The aft float unit is below the aft bridge, and is configured for floating on the water and supporting the aft bridge. The forward float assembly 170 includes a forward bridge 180 and a forward float unit 190, which is configured for floating on the water. The forward float unit and the aft float unit are configured for supporting the weight of the whole retractable dock. The aft bridge 160 and the forward bridge 180 are joined to each other, such that one of the bridges is slidable within the other bridge in a telescopic manner. In this manner, by moving the aft bridge 160 along the forward bridge 180 or by moving the forward bridge 180 along the aft bridge 160, the distance between the aft float unit 150 and the forward float unit 190 can be varied. Thus, the dock can be extended forward (away from the bulkhead) and retracted backward.

The aft end of the ramp 110 is joined to the bulkhead 115 by a first locking mechanism 120 which enables the ramp 110 to pitch with respect to the bulkhead (i.e. enables rotation of the ramp 110 with respect to the bulkhead 115 around a first substantially horizontal axis perpendicular to the long axis of the ramp). Optionally. The first locking mechanism includes a hinge joined to the ramp and to the bulkhead. In a variant, the locking mechanism 120 is further configured for enabling the ramp 110 to yaw with respect to the bulkhead (i.e., enables rotation of the ramp relative to the bulkhead along a substantially vertical axis). The forward end of the ramp 110 is attached to the aft bridge 160 of aft float assembly 140 or to the aft end of the aft float unit by a second locking mechanism 130. The second locking mechanism enables the aft float assembly to pitch and optionally yaw with respect to the ramp. Optionally, the second locking mechanism includes a second hinge. In the aft float assembly 140, the aft bridge 160 is joined to the aft float unit 150 by a third locking mechanism 310, which enables the aft bridge 160 to pitch with respect to the aft floating unit 150. To this end, the third locking mechanism may include a hinge, as will be discussed more in detail in the description of FIGS. 10 and 11.

The series of locking mechanisms that enable the pitching of the ramp with respect to the bulkhead, the pitching of the aft bridge with respect to the ramp, and the pitching of the aft bridge with respect to the aft float unit ensures that the retractable dock 100 is not rigid along its whole length. In this manner, the dock 100 is configured for adapting its geometry to the motion of the water in the body of water and for decreasing the risk of the dock's damage by the motion of water.

Figure 20:
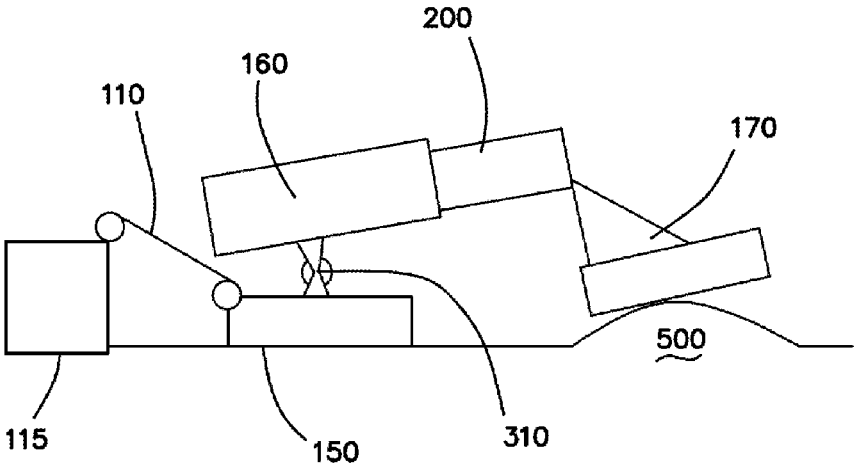
FIGS. 20 and 21 illustrate a schematic of the dock of the present invention interacting with a wave.
Figure 21:
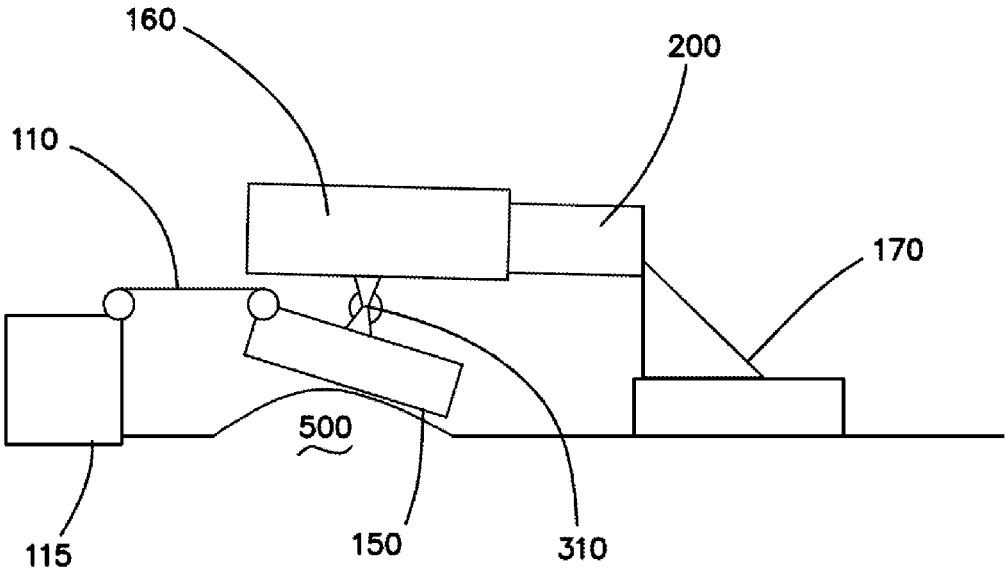

For example, as shown by FIGS. 20 and 21, a wave peak 500 travelling from the forward float assembly 170 to the bulkhead 115, will at first raise the forward float assembly 170. The forward end of the aft bridge 160 will be raised, and the aft bridge will pitch accordingly with respect to the aft float. In this manner, the aft float unit 150 will not be raised by the rising of the forward float assembly 170, and will therefore not add stress to the aft bridge 160 and to the elements joined to the aft bridge.

As the wave's peak 500 proceeds toward the bulkhead 115 and reaches the aft float unit 150, the forward float assembly 170 loses height while the aft float unit and the aft will be raised. As before, the series of hinging locking mechanism will enable the pitching of the aft bridge and aft float unit with respect to each other, and the pitching of the ramp with respect to the aft bridge and to the bulkhead. Thus, the shape of the dock 100 changes to adapt to the motion of the water.

Moreover, during low tide as the water level drops, the ramp 110 may pitch downward with respect to the bulkhead 115. In this manner, the aft float unit 150 can rest on the shallow water or on the beach. The dock 100 may be in its extended configuration, with the forward float assembly 170 located farther in the water. The dock may be in its retracted configuration, with the forward float unit located proximally to the aft float unit.

In some embodiments of the present invention, the forward float assembly 170 may connect to the aft float assembly 140 directly via the connection between the aft bridge 160 and the forward bridge one 180, as explained above. Optionally, the connection between aft bridge 160 and the forward bridge 180 is mediated by one of more additional bridges. As shown in the non-limiting example of FIGS. 1 and 2, a second bridge 200 is joined to the forward end of the aft bridge, while a third bridge 210 is joined to the forward end of the second bridge and to the aft end of the forward bridge.

In the non-limiting example of FIGS. 1 and 2 a given bridge is configured to be partially contained and partially supported by a wider bridge joined to the given bridge's aft end. For example, the forward end of aft bridge 160 supports the aft end of second bridge 200; the forward end of the second bridge 200 supports the aft end of the third bridge 210; and the forward end of the third bridge 210 supports the aft end of the forward bridge 180. In this configuration, when the bridge is retracted a given bridge slides into the wider bridge joined to the given bridge's aft end.

Alternatively, a given bridge is configured to be partially contained and partially supported by a wider bridge joined to the given bridge's forward end. In such an embodiment, the forward end of the aft bridge 160 is supported by the aft end of the second bridge 200; the forward end of the second bridge 200 is supported by the aft end of the third bridge 210; and the forward end of 210 supported by the aft end of 180. In this configuration, when the bridge is retracted a given bridge slides into the wider bridge joined to the given bridge's forward end.

Figure 3:
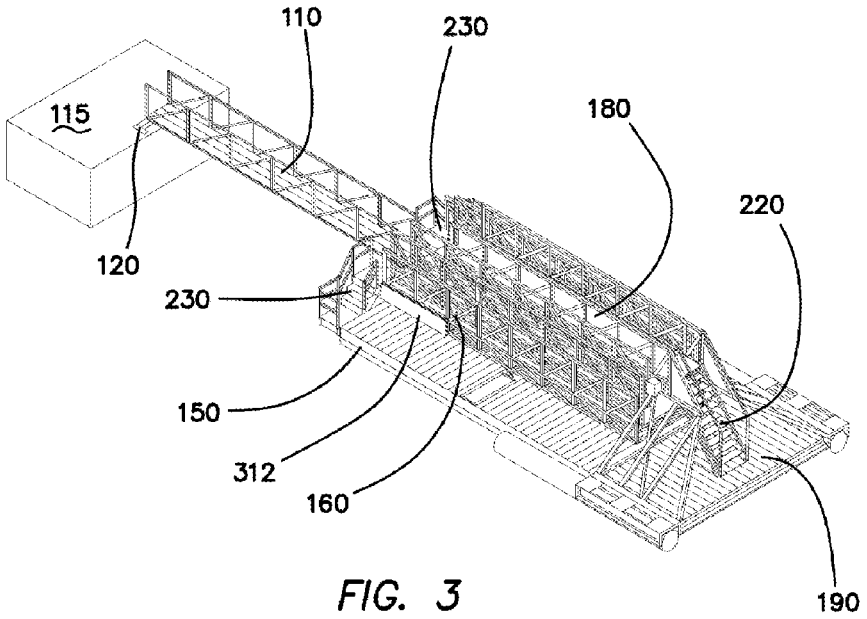
FIG. 3 is a perspective view of the dock of the present invention in a retracted configuration thereof.

FIG. 3 is a perspective view of the dock 100 in a retracted configuration thereof. In the non-limiting example of FIG. 3, the bridges 160, 200, 210, and 180 are supported one on top of the other, such that the aft bridge 160 is directly below and supports the second bridge 200. The second bridge 200 is directly below and supports the third bridge 210. The third bridge 210 is directly below and supports the forward bridge 180. In this embodiment the aft bridge 160 is the widest bridge with each succeeding bridge being less wide: the aft bridge 160 is wider than the second bridge 200, which is wider than the third bridge 210, which is wider than the forward bridge 180. In this manner, the narrow bridges can retract into the wider bridges. Counter weights 312 may be present on both sides to reduce the bending moment and deflections in bridges when extended.

In another embodiment the bridges 160, 200, 210, and 180 are supported one on top of the other when the dock is retracted, such that the aft bridge 160 is directly above and supported by the second bridge 200. The second bridge 200 is directly above and supported by the third bridge 210. The third bridge 210 is directly above and supported by the forward bridge 180. In this embodiment the forward bridge 180 is the widest bridge with each proceeding bridge being less wide: the forward bridge 180 is wider than the third bridge 210, which is wider than the second bridge 200, which is wider than the aft bridge 160. This is so that the narrow bridges can retract into the wider bridges.

Figure 4:
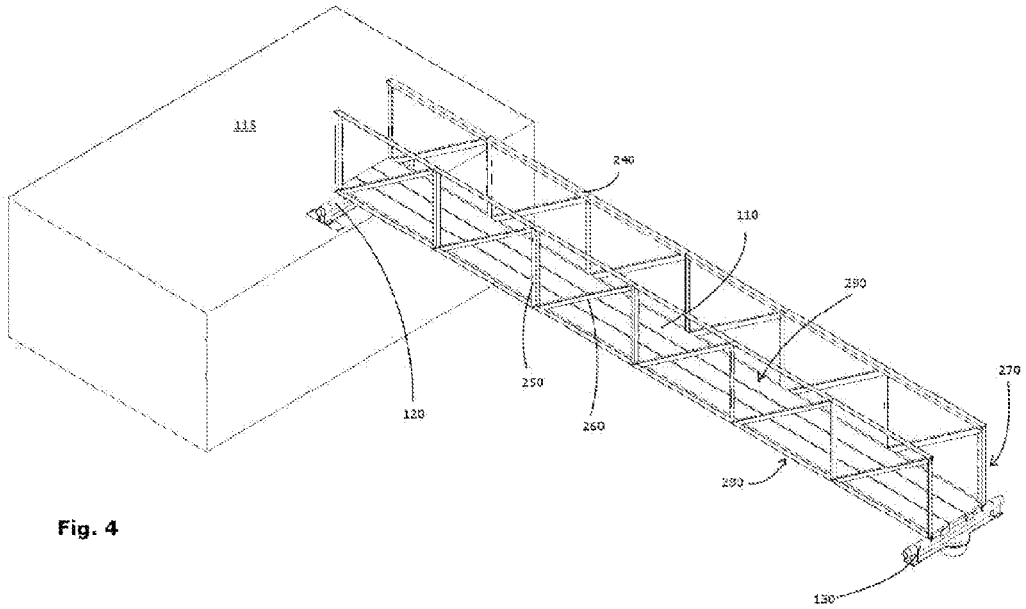
FIGS. 4 and 5 are drawings illustrating a perspective view and a side view of a ramp of the dock of the present invention.
Figure 5:
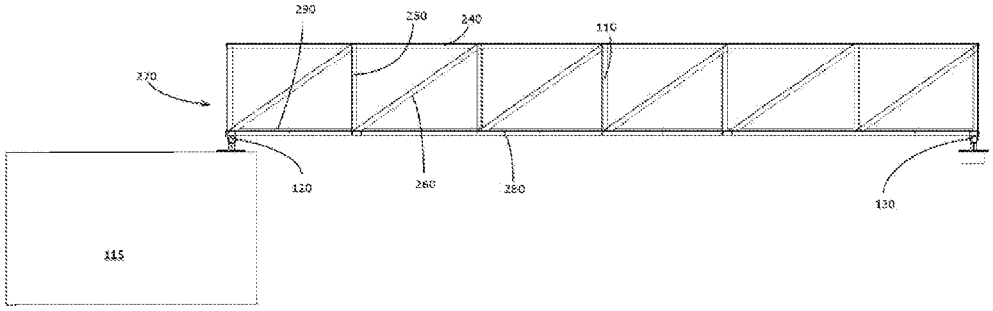

FIGS. 4 and 5 are drawings illustrating a perspective view and a side view of a ramp 110, according to some embodiments of the present invention. The aft side of the ramp 110 connects to the bulkhead 115 by a locking mechanism 120 that allows for the ramp's rotation about the horizontal axis and, optionally, vertical axis. The bulkhead 115 connects the dock 100 to dry land.

In some embodiment of the present invention illustrated by FIGS. 4 and 5, the ramp 110 includes a railing 270 and a floor 280. In a variant, the railing 270 includes a series of horizontal supports 240, vertical supports 250, and diagonal 260 supports. The vertical supports 250 rise from the floor 280 and support the horizontal supports 240. Each diagonal support 260 has an aft end joined to the bottom end of a horizontal support 240 and a forward end joined to the top of the successive horizontal support 240. Optionally, the supports are made of wood, metal, plastic, or any substantially rigid material. The floor 280 may include one or more floor plates 290, which may be made of any rigid material, such as metal, wood, etc.

Figure 6:
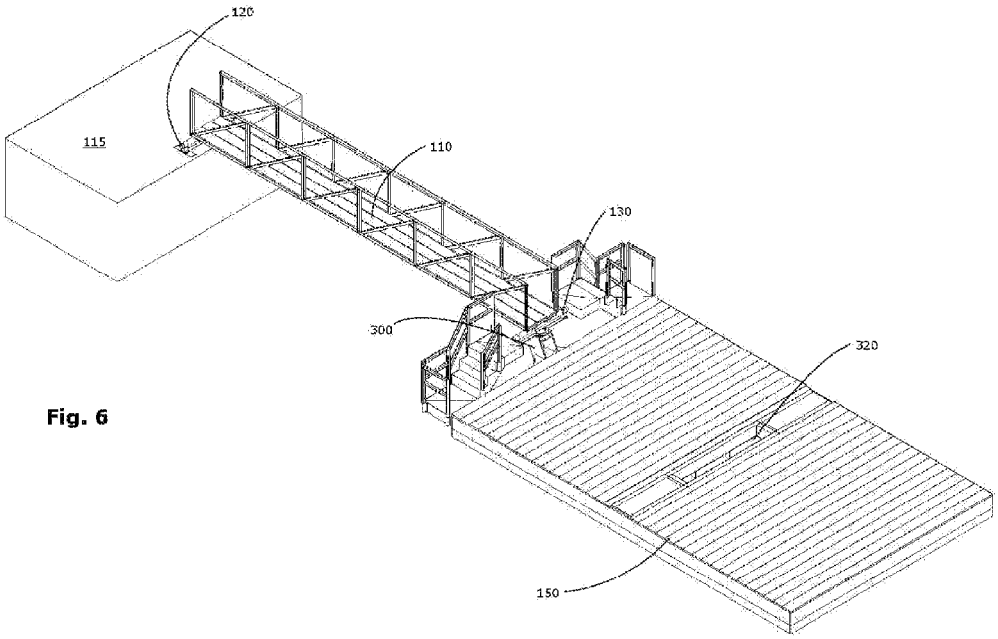
FIGS. 6 and 7 are perspective views respectively showing the top and the bottom of the ramp and aft float unit, according to some embodiments of the present invention.

FIG. 6 is a perspective view of the ramp 110 and aft float unit 150. In some embodiments of the present invention, the ramp 110 connects to the aft float unit 150 via the second locking mechanism 130. The second locking mechanism may be, for example, joined to a raiser 300 which extends upward from the aft float unit 150. The second locking mechanism 130 allows for rotation about the horizontal axis as water level changes. Optionally, the second locking mechanism 130 is joined to the raiser to further enable rotation of the aft float assembly around a vertical axis. The raiser 300 lifts the edge of the ramp 110 to a height that allows for access to the aft bridge 160. The aft float unit 150 is created from any rigid material, such as metal, wood, etc. The aft float unit may have one or more apertures 320 that allow for the placement of the third locking mechanism 310.

Optionally, the aft float unit includes one or more anchor locks. The anchor locks are configured for being removably joined to tethers that are fixedly joined to anchors. In this manner, the motion of the aft float assembly is limited. Optionally, the anchors include screws that are screwed into the ground at low tide and can be rated up to 17,000 lbs each. Optionally, the anchor screws are located at two places on each side outboard approximately 20 feet from the Aft Float Assembly. Tether lines may cross under the float. This allows for adjustability of tether length allowing for a longer tether while providing the float to be in deeper waters.

Figure 7:
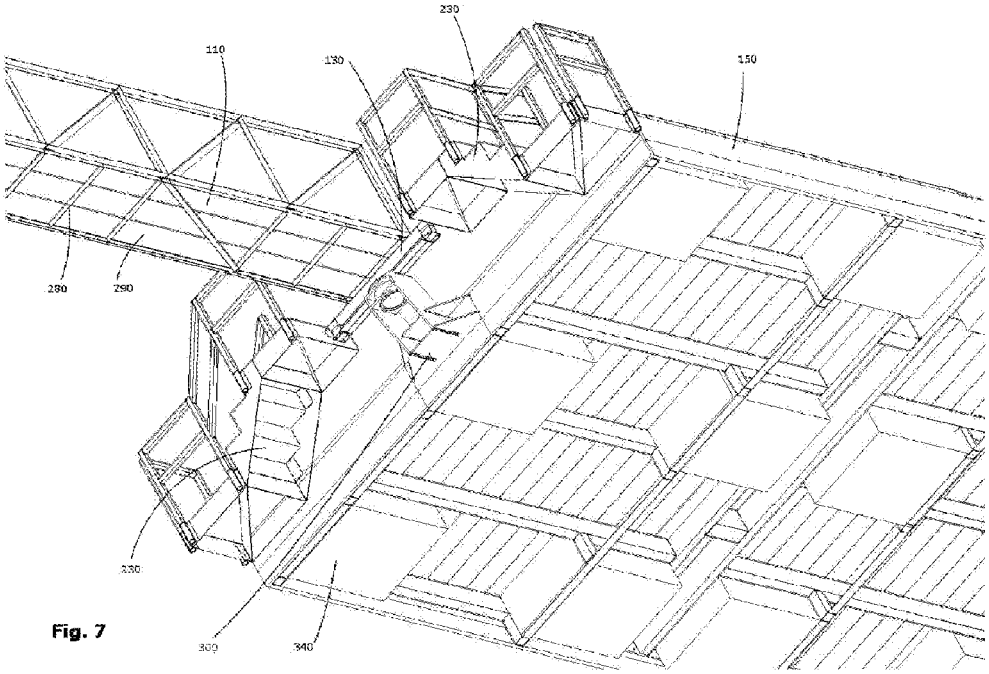

FIG. 7 is a perspective view of the bottom of the ramp 110 and aft float unit 150. The bottom view shows the floor support structure 180 that floor plates 290 can be built on. The floor support structure may include a plurality of bars connected to shaft on sides of the ramp. The raiser 300 is attached to the aft end of the aft float unit 150. The aft float unit 150 includes one or more floatation devices 340 joined to the underside of the aft float unit 150 and configured for enabling the aft floating unit to float. In a variant, the floatation devices are uniformly distributed throughout the bottom surface of the aft float unit 150, so as to provide uniform buoyancy over a large area, and thereby enhancing the stability of the aft float unit 150. In this manner, the risk of capsizing is lowered. Examples of the floatation devices 340 are produced by Harbor Ware and ACE. Harbor Ware (www.harborware.com/dock-floats) offers floatation devices in over fifty five sizes, so a plurality of combinations of different floatation devices may be used in the dock of the pre. Some floatation devices sold by ACE (www.denhartogindustries.com/commercial-floats) are made from durable polyethylene and form filled virgin grade EPS polystyrene. The floatation devices 340 may have lateral mounting slots for being joined to the respective floats units.

Figure 8:
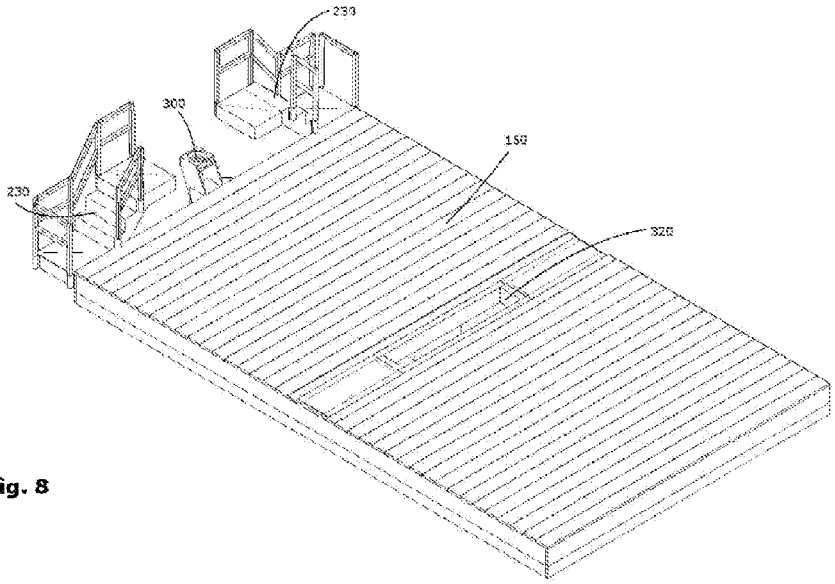
FIG. 8 is a perspective view of the aft float unit.

FIG. 8 is a perspective view of the aft float unit 150. In some embodiments of the present invention, the aft float unit has at least one walkways 230 that leads from the ramp to the aft float unit 150 surface. In this manner, access to the surface of the aft float unit 150 is provided, for example for maintenance.

Figure 9:
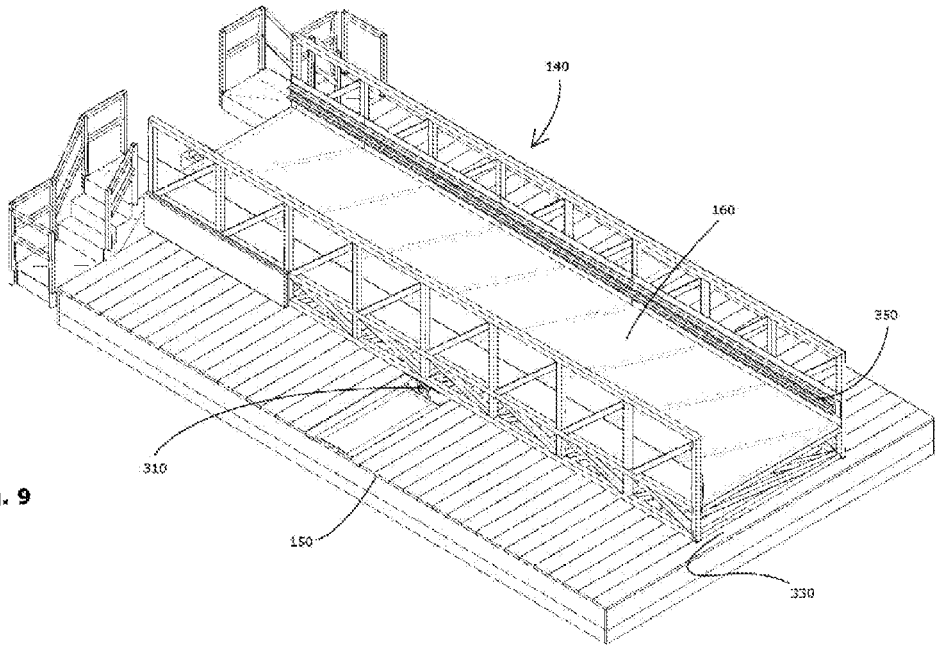
FIGS. 9 and 10 are drawings illustrating a perspective view and a side view, respectively, of the aft float assembly, according to some embodiments of the present invention.
Figure 10:
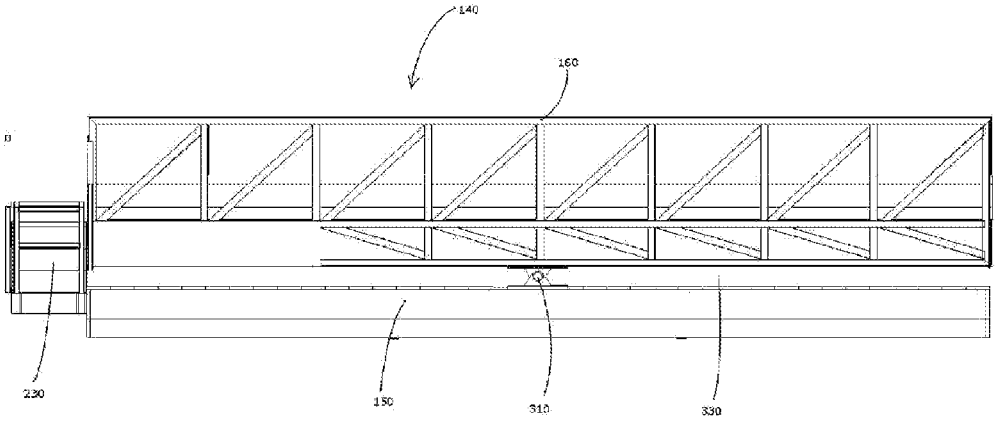

FIGS. 9 and 10 are a perspective view and a side view of the aft float assembly 140, which includes the aft float unit 150 and the aft bridge 160. The aft bridge 160 connects to the aft float unit 150 through a third locking mechanism 310. As mentioned above, the third locking mechanism may engage to one or more apertures 320 located on the aft float unit 150.

The third locking mechanism 310 provides a gap 330 between the aft bridge 160 and aft float unit 150, and allows for the aft bridge's rotation relative to the aft float unit about a horizontal axis. The third locking mechanism is in this embodiment directly between the aft bridge 160 and the aft float unit 150 because the aft bridge 160 is the lowest bridge. In another embodiment, where the forward bridge 180 is the lowest bridge, the third locking mechanism 310 could extend laterally outward from the railings 270 of the aft bridge 160 and then downwardly to aperture 320 in the aft float unit. When the bridges are extended or retracted this would still function as described previously regarding FIGS. 20 and 21, by allowing the retracted bridges to be supported from above.

Figure 18:
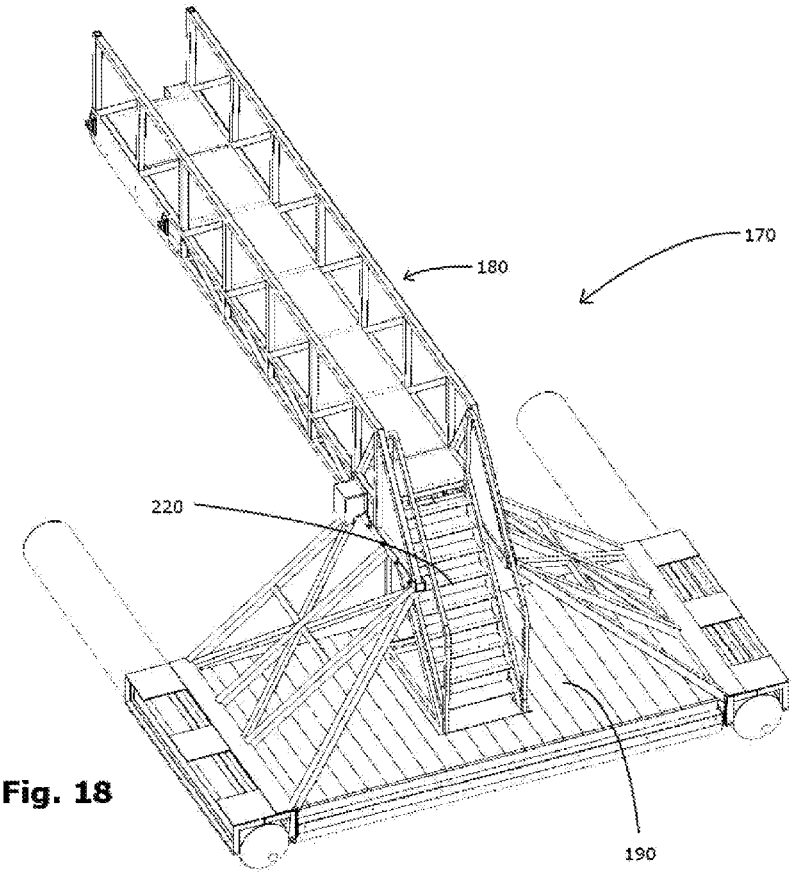
FIG. 18 is a perspective view illustrating an example of a forward float assembly comprised in the retractable of the present invention.
Figure 19:
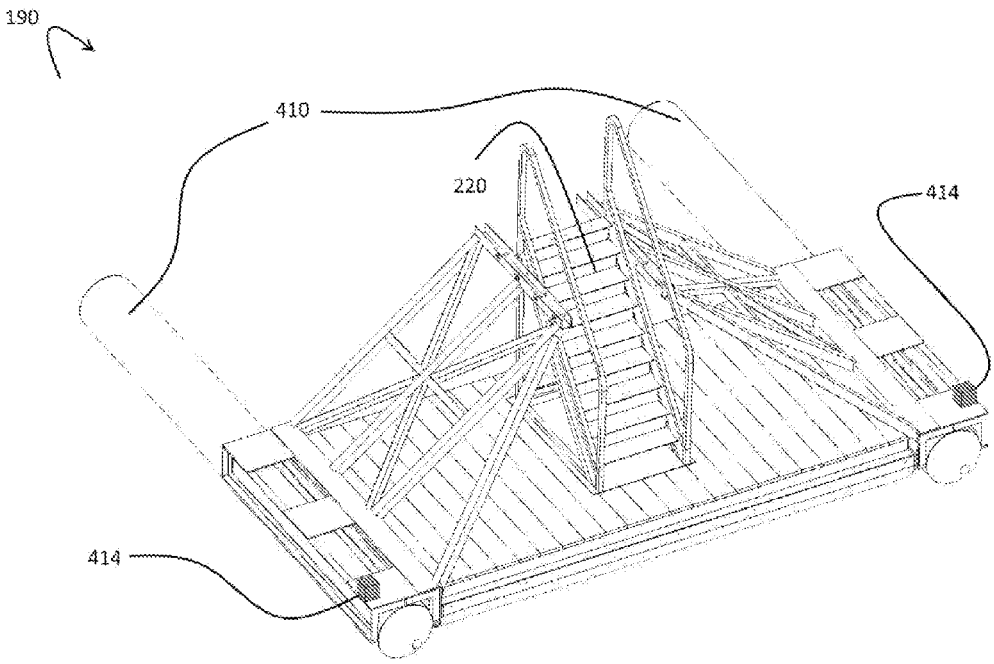
FIG. 19 is a perspective view of a forward float unit which is part of the forward float assembly of the present invention.

FIG. 18 is a perspective view illustrating an example of a forward float assembly 170 comprised in the retractable of the present invention. FIG. 19 is a perspective view of the forward float unit 190.

The forward float assembly is the final assembly to be crossed before boarding the docked naval vessel. The forward float assembly comprises a forward bridge 180 and forward float unit 190. The forward float assembly 170 may contain a walkway 220 of stairs leading from the forward bridge 180 to the forward float unit 190. This walkway 220 is of a height allowing a user to travel from the uppermost bridge, which is the forward bridge 180 in this embodiment, to the forward float unit 190. In this embodiment stabilizing floatation devices 410 are on either side of the forward float unit 190, for balancing the dock and decreasing the risk of capsizing.

Figure 23:
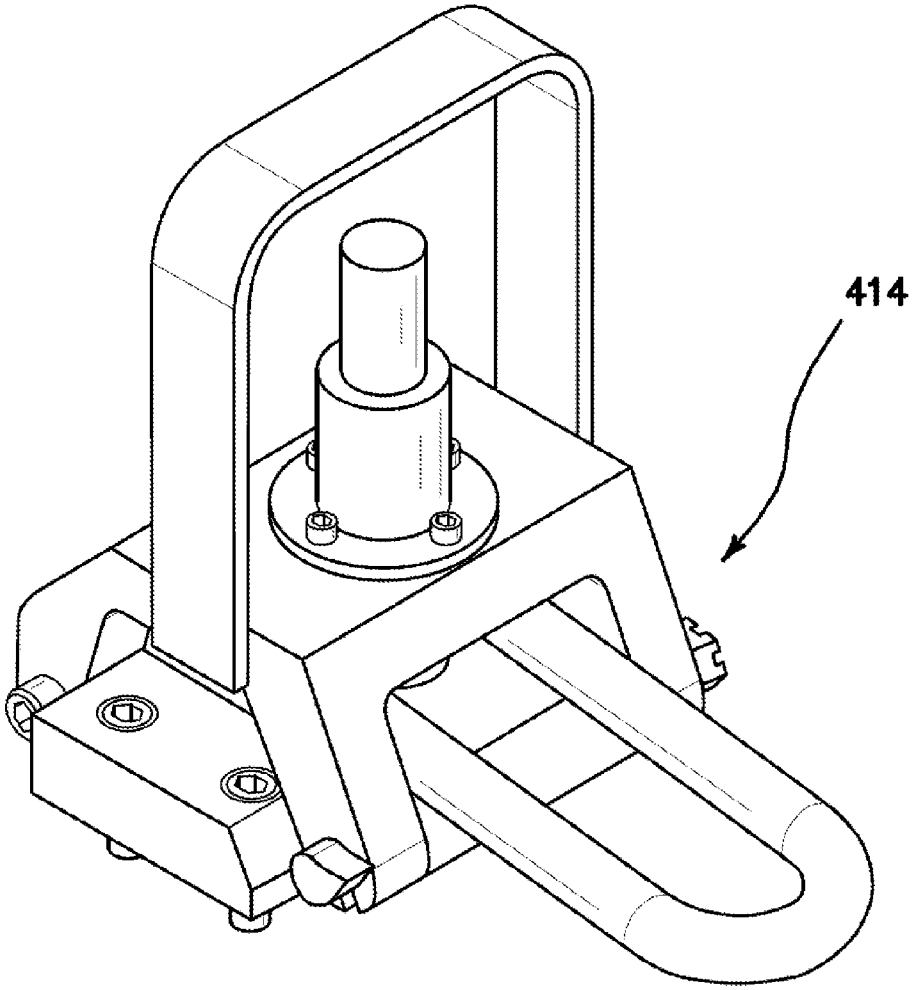
FIG. 23 illustrates a perspective view of the anchor lock, according to some embodiments of the present invention.

In a variant, one or more second anchor locks 414 are joined (e.g., bolted) on one side or on each side of the forward float assembly and are configured for being removably tethered to anchors, as described above with reference to the aft float assembly. Optionally, the anchors are anchor screws screwed into the bottom of the ocean floor. In non-limiting example, the anchor screws are rated up to 17,000 lbs and are located approximately 20 feet outboard on each side of the forward float assembly. The second anchor locks 414 are not restricted to one location. They may be positioned as desired by the user. In the non-limiting example of FIG. 19, two of anchor locks 414 are joined to respective to the forward end of the top surface of the forward float unit 190. The tethered anchors are necessary to prevent the forward float assembly from drifting too far from each side and to assist in keeping the forward float assembly stable when contact is made with another vessel. The lines (nylon) connecting the anchors to the second anchor locks may be joined to buoys, so that the end of each line is easy to reach from the forward float unit. A non-limiting example of a (first and/or second) anchor lock is illustrated in FIG. 23.

FIGS. 11-14 are perspective views of an additional bridge unit located between the aft bridge and the forward bridge, according to some embodiments of the present invention In this embodiment, bridge section 160, 200, 210, and 180 have respective railings and floor structures similar to those of the ramp 110. The floor plates 290 may be made of the same or different materials on different parts of the retractable dock.

The bridge 200 further includes one or two tracks 350 and at least one lock glider 360. The track(s) extend(s) on the side(s) of the bridge 200 along at least part of the bridge's length. The lock glider 360 is located on the side of the bridge 200, and is configured for engaging to the track of a first adjacent bridge. In this manner, the motion of the bridge 200 with respect to the first adjacent bridge is limited to translation along the first adjacent bridge. Similarly, the track(s) 350 is (are) configured for engaging to the lock glider(s) of a second adjacent bridge and limiting the motion of the second adjacent bridge with respect to the bridge 200 to translation along the bridge 200. In some embodiments of the present invention, the bridge 200 includes three lock gliders 360. The first lock glider is at a first edge of the bridge 200; the second lock glider is at a distance of about ¼-⅓ of the bridge's length from the first edge; the third lock glider is at a distance of about ⅓-¾ of the bridge's length from the first edge. The lock gliders 360 may have dual bearings or single bearings. The type of bearing on the lock gliders 360 may be dual or single, and may be chosen according to the weight of the bridges.

In some embodiments of the present invention, the track is on the inner part of the side of the bridge 200, while the lock glider is on the outer part of the side of the bridge 200. Alternatively, the track is on the outer part of the side of the bridge 200, while the lock glider is on the inner part of the side of the bridge 200.

Optionally, the bridge 200 includes one or more floor locks 362. The floor locks 362 are configured for being inserted into openings 364 on the floor plates 290 of the adjacent bridge for locking the bridges together to keep the dock extended. Before the dock is brought to its retracted configurations, the floor locks 362 are raised, to unlock the bridges and enables the motion of the bridges.

Figure 11:
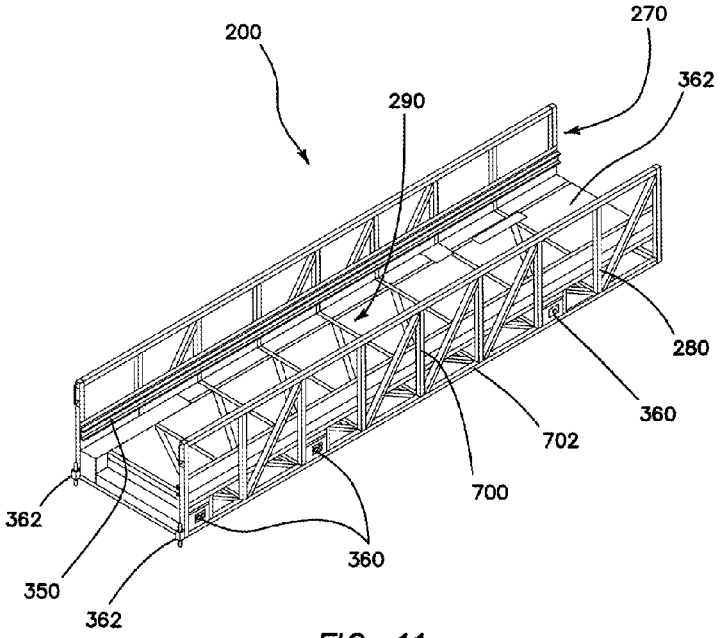
FIGS. 11-14 are perspective views of an additional bridge unit located between the aft bridge and the forward bridge, according to some embodiments of the present invention.
Figure 12:
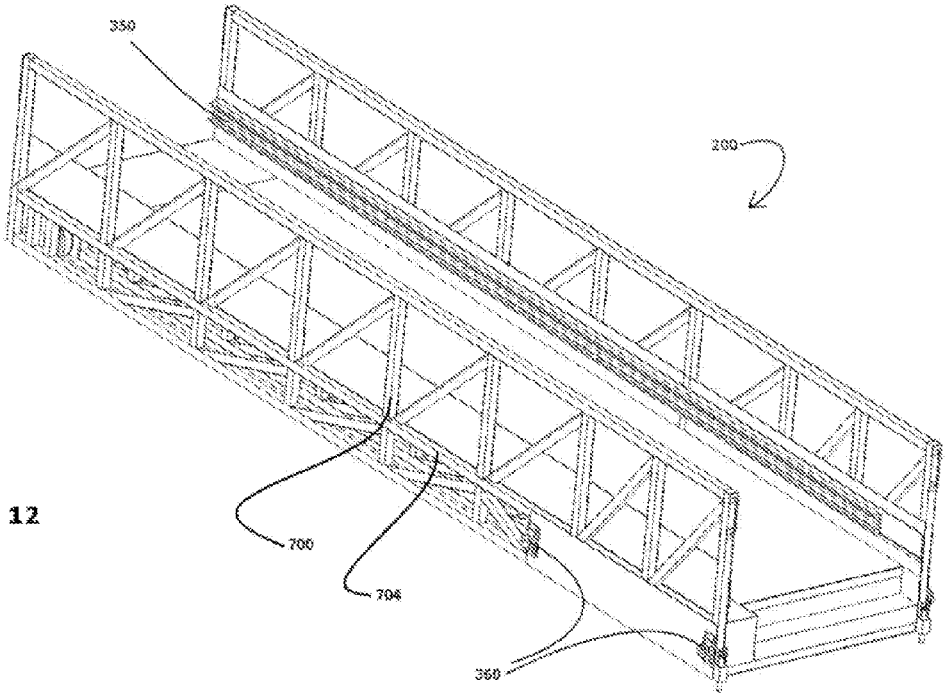

In comparing FIG. 11 and FIG. 12 it is possible to see that various optional constructions of the support structures of the bridge are possible. One variation shows in FIG. 11 a vertical post 700 extending to the bottom horizontal post 702. In another variation in FIG. 12 the vertical post 700 extends to an intermediate horizontal post 704. Variations on arrangements of posts such as the horizontal, vertical, and diagonal posts can be made according to need or available materials.

Figure 13:
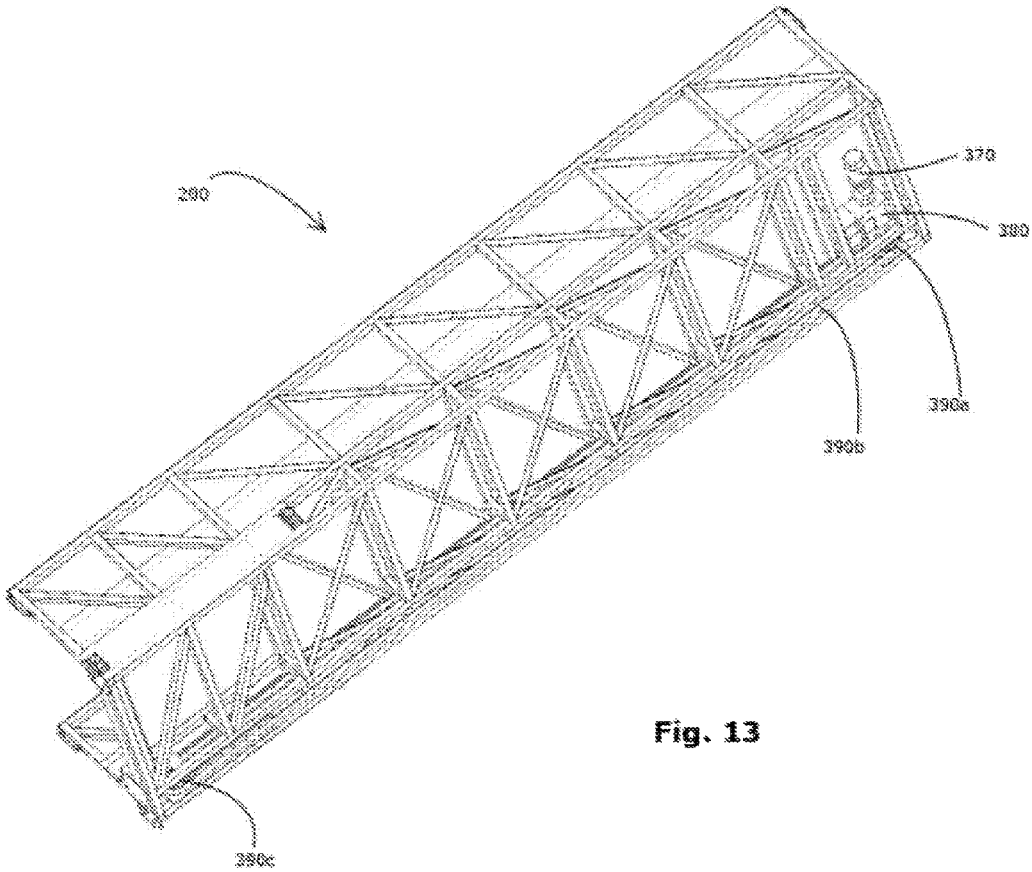
Figure 14:
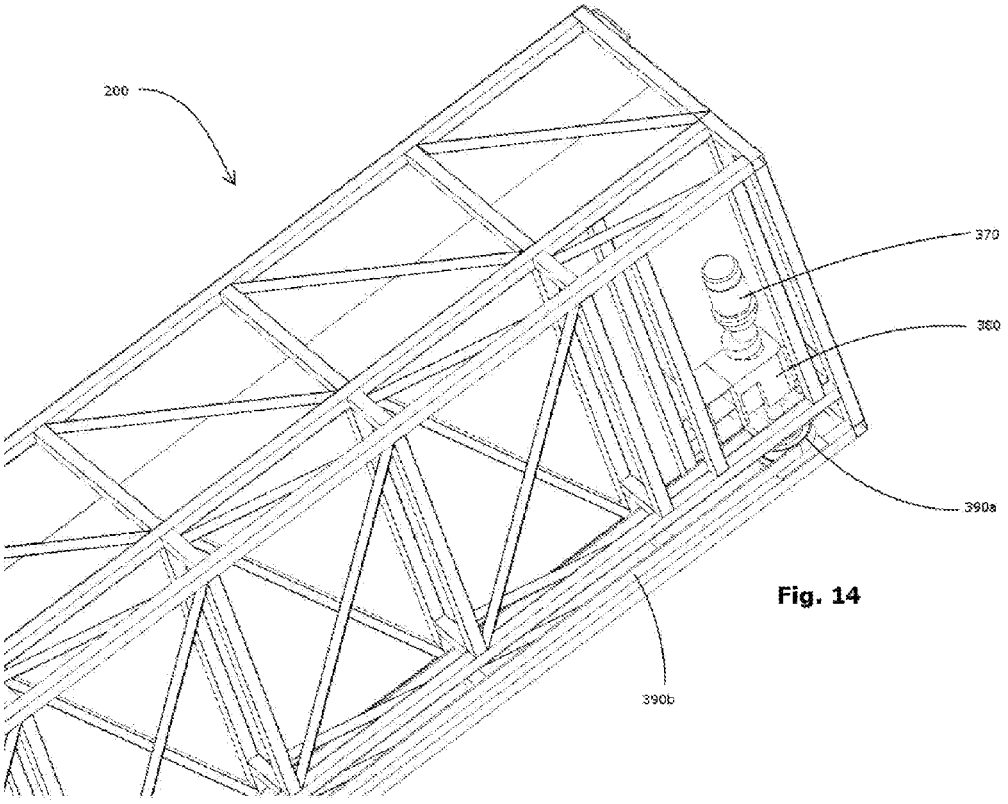
Figure 22:
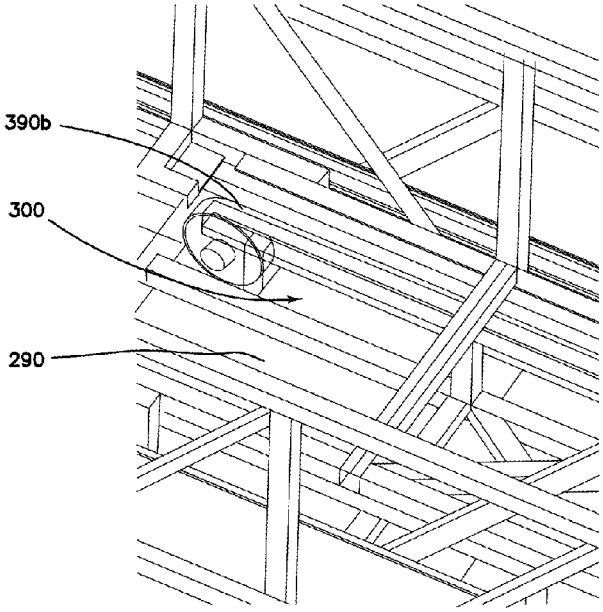
FIG. 22 illustrates a detailed view of some embodiments of the present invention in which a clamp attachment pad ensures that contact between a belt of a first bridge and the floor of the second bridge is maintained.

FIGS. 13 and 14 illustrate perspective view of the bottom of the second bridge 200. In a variant, the bridge 200 includes a motor 370, and a belt and pulley system 390, which includes a first pulley 390*a*, a belt 390*b*, and a second pulley 390*c*. The motor is joined to the first pulley 390*a*, such that the rotation of the motor causes to first the pulley to rotate about the first pulley's center. The belt 390*b* is stretched between the first pulley 390*a* and the second pulley 390*c*. Thus, the rotation of the first pulley causes the belt to rotate between the first and second pulleys. The bottom section of the belt is in contact with an adjacent bridge. Thus, as the belt rotates, the bridge 200 translates along the adjacent bridge. The motor enables automated retraction and extension of the dock. In another embodiment the motor is replaced by a manual device which enables a user to manually operate the gearbox bridges could be manually retractable. In some embodiments of the present invention illustrated in FIG. 22, a clamp attachment pad 800 is joined to the top of the floor plate 290 of a first bridge. The clamp attachment pad 800 pushes the belt 390*b* of a second bridge toward the top of the floor plate 290 of the first bridge, thus maintaining contact between the belt of the second bridge and the floor of the first bridge.

In some embodiments of the present invention, the motor is joined to the first pulley 390*a* via a gearbox 380. The gearbox includes speed changing gears and a shaft. The motor is joined to the gears such that the motor's rotation causes the gears to rotate. One of the gears is joined to the shaft, which is in turn joined to the first pulley. The rotation of the gears causes the rotation of the shaft, which causes the rotation of the first pulley. The speed changing gears transmit to the first pulley an output torque that differs from the input torque generated by the motor. In this manner, the rotational speed of the first pulley (and consequently of the belt) can be controlled, enabling control of the translation of the bridge 200 along the adjacent bridge.

In the embodiment in which a plurality of bridges is present, the motors of the bridges may be connected to a control system, configured for timing the operation of each motor. In this manner, the dock's extension and retraction can be automated to occur in a desired manner.

In a non-limiting example, a suitable motor is a HP electric motor, the gearbox is a NORD helical speed reducer model SR 42/12 with a 2 rpm output speed. The motor that's mounted to the speed reducer is a C-face design. The speed reducer is attached by bolting it to the structure. The speed reducer shaft is connected to a drive pulley shaft. The pulleys are two Cross Morse Type 1 pulleys (part number P72H300) located at each end of the bridge.

Figure 15:
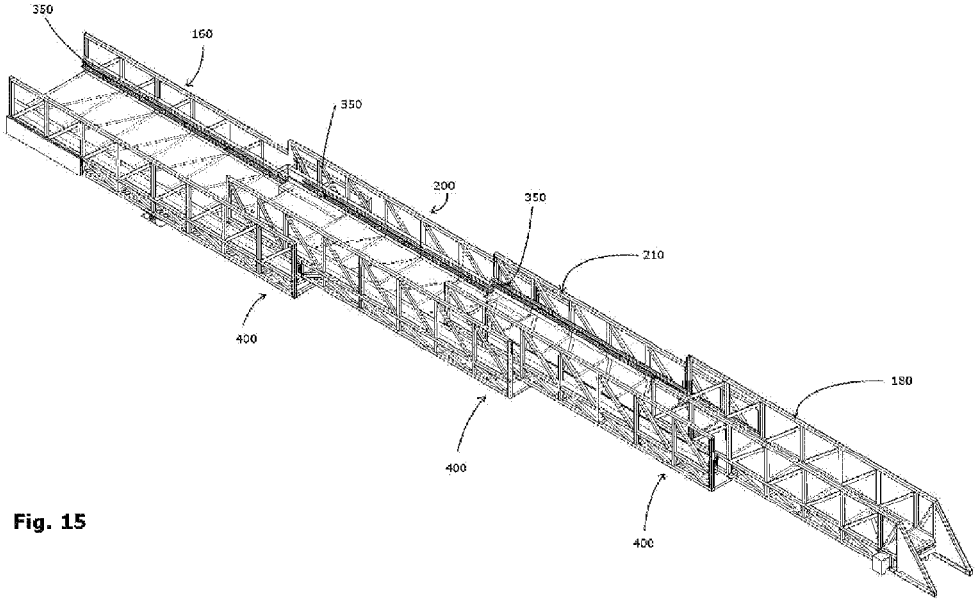
FIGS. 15-17 illustrate different views of an extended mode of a set of bridges comprised in the dock of the present invention, the set of being telescopically extendible and retractable.
Figure 16:
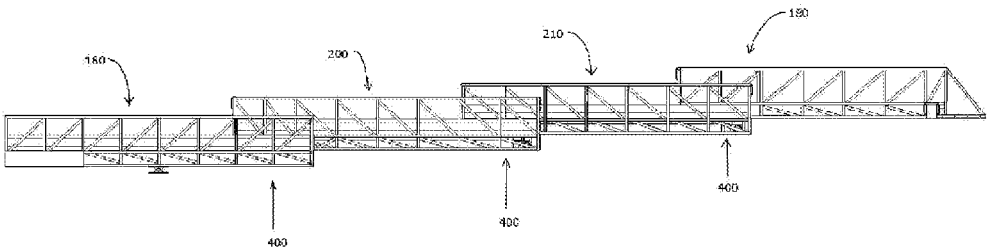
Figure 17:
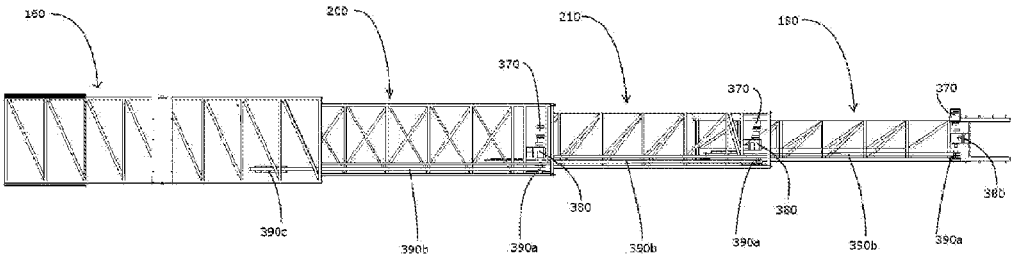

FIGS. 15-17 illustrate different views of an extended mode of a set of bridges (bridges 160, 200, 210, and 180) comprised in the dock of the present invention, the set of being telescopically extendible and retractable. FIG. 15 illustrates a perspective view, FIG. 16 illustrates a side view, and FIG. 17 illustrates a bottom view of the set of bridges.

The example of FIGS. 15-17 illustrates four bridges. The scope of the present invention, however, extends to any number of bridges greater than one. In the embodiment of FIGS. 15-17, the tracks 350 are present on the aft bridge 160 and the on the bridges 200 and 210. The floor lock gliders 360 are present but not visible on the two optional bridges 200 and 210 and the forward bridge 180. The floor lock gliders 360 are not visible because they are located between the bridge that they are on and the tracks of wider bridge. The floor lock gliders 360 also manually lock when extended and can lock the bridges such as that they are supported by an overlap 400. In the embodiment of these figures, the forward bridge 180 is configured for being translated within the second bridge 210. The second bridge 210 is configured for being translated within the first bridge 200. The first bridge 200 is configured for being translated within the aft bridge 160. Thus, all bridges except for the aft bridge 160 include respective motors 370, belt and pulley systems 390, and optionally gearboxes 380, as seen in FIG. 17.

In an alternative variant, the aft bridge 160 is configured for being translated within the first bridge 200. The first bridge 200 is configured for being translated within the second bridge 210. The second bridge 210 is configured for being translated within the forward bridge 180. Thus, all bridges except for the forward bridge 180 include respective motors 370, belt and pulley systems 390, and optionally gearboxes 380.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A retractable dock, comprising:

(i) a ramp extending from a bulkhead on dry land toward a body of water, the ramp having a first aft side and a first forward side, the aft side being joined to the bulkhead via a first locking mechanism which enables rotation of the ramp with respect to the bulkhead around a first substantially horizontal axis;

(ii) an aft floating assembly, comprising:

(iia) an aft bridge having a second aft side and a second forward side, the second aft side being joined to the first forward side of the ramp via a second locking mechanism which enables rotation of the aft bridge with respect to the ramp around a second substantially horizontal axis;

(iib) an aft floating unit configured for floating on the body of water and supporting the aft bridge, the aft floating unit being joined to the aft bridge by a third locking mechanism which enables rotation of the bridge with respect to the aft floating unit around a third substantially horizontal axis; and (iic) a second locking mechanism joined to the ramp and to one of the second aft side or to the aft floating unit, the second locking mechanism being configured for enabling rotation of the aft floating assembly with respect to the ramp around a second substantially horizontal axis; and (iii) a forward floating assembly, comprising:

(iiia) a forward bridge joined to the aft bridge, and configured for telescopically extending from and retracting to the aft bridge; and (iiib) a forward floating unit for floating on the body of water joined to the forward bridge, and configured for supporting at least part of a weight of the forward bridge;

the forward floating unit and the aft floating unit being configured for together supporting the forward bridge and aft bridge.

2. The retractable dock of claim 1 further comprising at least one bridge unit joined to the aft bridge and to the forward bridge, such that the at least one bridge unit is configured for telescopically extending from and retracting to the aft bridge, while the forward bridge is configured to telescopically extend from and retract to the at least one bridge unit.

3. The retractable dock of claim 2, wherein:

the at least one bridge unit comprises a set of bridges arranged in series, the set being telescopically extendible from and retractable;

a first bridge of the set is joined to the aft bridge, and is configured for telescopically extending from and retracting to the aft bridge;

a last bridge of the set is joined to the forward bridge, such that the forward bridge is configured for telescopically extending from and retracting to the aft bridge.

4. The retractable dock of claim 1 further comprising an electric motor and pulley system for operating the telescopic retraction and extension, the electric motor and pulley system comprising:

a first pulley and a second pulley, the first pulley being located at a more forward location along the forward bridge than the second pulley;

a belt stretched between the first and second pulleys such that the belt rotates about the first and second pulleys when a least one of the first and second pulleys rotates;

a motor connected to the first pulley and configured for causing the first pulley to rotate about the first pulley's center, wherein the belt is in contact with the aft bridge such that a motion of the belt causes the forward bridge to translate along to the aft bridge.

5. The retractable dock of claim 4 further comprising:

a track extending on the side of the aft bridge along at least part of the aft bridge's length; and at least one lock glider, joined to forward bridge and configured for engaging the track, so as to restrict a motion of the forward bridge along the aft bridge to translation.

6. The retractable dock of claim 4 further comprising, comprising a clamp attachment joined to a top surface of the aft bridge and configured for pushing the belt of the forward bridge against the top surface of the aft bridge, thus maintaining the contact between the forward bridge's belt and the aft bridge's top surface.

7. The retractable dock of claim 3, wherein a motion of at least one bridge with respect to a second bridge adjacent to the at least one bridge located at a more forward location than the at least one bridge is caused by an electric motor and pulley system, which comprises:

a first pulley and a second pulley, the first pulley being located at a more forward location along the adjacent bridge than the second pulley;

a belt stretched between the first and second pulleys such that the belt rotates about the first and second pulleys when a least one of the first and second pulleys rotates;

a motor connected to the first pulley and configured for causing the first pulley to rotate about the first pulley's center, wherein the belt is in contact with the at least one bridge such that a motion of the belt causes the adjacent bridge to translate along to the at least one bridge.

8. The retractable dock of claim 7, further comprising:

a track extending on the side of the aft bridge along at least part of a length of the at least one bridge; and at least one lock glider, joined to adjacent bridge and configured for engaging the track, so as to restrict a motion of the adjacent bridge along the at least one bridge to translation.

9. The retractable dock of claim 7, further comprising, comprising a clamp attachment joined to a top surface of the at least one bridge configured for pushing the belt of the adjacent bridge against the top surface of the at least one bridge, thus maintaining the contact between the adjacent bridge's belt and the top surface of the at least one bridge.

10. The retractable dock of claim 1 further comprising an electric motor and pulley system for operating the telescopic retraction and extension, the electric motor and pulley system comprising:

a first pulley and a second pulley, the first pulley being located at a more aft location along the aft bridge than the second pulley;

a belt stretched between the first and second pulleys such that the belt rotates about the first and second pulleys when a least one of the first and second pulleys rotates;

a motor connected to the first pulley and configured for causing the first pulley to rotate about the first pulley's center;

wherein the belt is in contact with the forward bridge such that a motion of the belt causes the aft bridge to translate along to the forward bridge.

11. The retractable dock of claim 10 further comprising:

a track extending on the side of the forward bridge along at least part of the forward bridge's length; and a lock glider, joined to aft bridge and configured for engaging the track, so as to restrict a motion of the aft bridge along the forward bridge to translation.

12. The retractable dock of claim 1 further comprising at least one removable and/or permanent floor plate on at least one of the aft bridge and forward bridge such that a walkable surface is provided.

13. The retractable dock of claim 1 further comprising an aft anchor lock joined to the aft floating unit configured for detachably engaging an end of an anchor line extending from an anchor affixed to dry land and/or to a bed of the body of water.

14. The retractable dock of claim 1 further comprising a forward anchor lock joined to the aft floating unit configured for detachably engaging an end of an anchor line extending from an anchor affixed to a bed of the body of water.

15. The retractable dock of claim 1 further comprising floatation devices joined to the aft and forward floatation units.

16. The retractable dock of claim 15, wherein the floatation devices are joined to the lateral edges of the aft and/or forward floatation units.

17. The retractable dock of claim 15, wherein the floatation devices are uniformly distributed throughout bottom surfaces of the aft and/or forward floatation units.

18. The retractable dock of claim 1, further comprising one or more counterweights on the aft floating unit and/or forward floating unit for balance during extension.

19. The retractable claim of claim 1, further comprising at least one floor lock, the floor lock being joined to:

the forward bridge, and being configured for being inserted into an opening on a forward end of a floor of the aft bridge, to lock the forward bridge and aft bridge when the forward bridge is extended from the aft bridge, and for being retracted from the opening to enable motion of the forward bridge with respect to the aft bridge; or the aft bridge, and being configured for being inserted into an opening on a aft end of a floor of the forward bridge, to lock the aft bridge and aft bridge when the aft bridge is extended from the forward bridge, and for being retracted from the opening to enable motion of the aft bridge with respect to the forward bridge.

* * * * *